United States Patent [19]

Malak

[11] 4,242,181

[45] Dec. 30, 1980

[54] COPPER PLATING PROCESS FOR PRINTED CIRCUIT BOARDS

[75] Inventor: Thomas P. Malak, Garfield Heights, Ohio

[73] Assignee: The Harshaw Chemical Company, Cleveland, Ohio

[21] Appl. No.: 93,081

[22] Filed: Nov. 9, 1979

[51] Int. Cl.[3] ..... C25D 3/38

[52] U.S. Cl. ..... 204/52 R

[58] Field of Search ..... 204/52 R, 24

[56] References Cited

U.S. PATENT DOCUMENTS 3,769,179 10/1973 DuRose et al. ..... 204/24

*Primary Examiner*—G. L. Kaplan

*Attorney, Agent, or Firm*—James A. Lucas

[57] ABSTRACT

Printed circuit boards are plated with a high acid-low copper sulfate bath which uses a grain refining agent comprising the extract of regular coffee added in an amount of between 0.1 and 1.0 g/l of bath solution. The bath is operated at a plating current density of between 15 and 60 asf and a bath temperature in the range of 20° to 40° C.

4 Claims, No Drawings

COPPER PLATING PROCESS FOR PRINTED CIRCUIT BOARDS

BACKGROUND OF THE INVENTION

Printed circuit boards are used in large numbers in telecommunications, computers and other electronic applications. Systems employing printed circuits normally use boards with circuits on both sides of one board, or in the case of multi-layer boards, circuits at each interface within a board. The boards are perforated with holes and the walls of the holes are made conductive to electrically connect circuits on one side of the board with the circuits on the other side of the board. The boards are generally made of paper-epoxy, paper-phenolic or epoxy-glass cloth. Initially, the perforations are non-conductive. However, the boards are typically catalyzed to make them receptive to electroless copper deposition over which electrolytic copper is plated. This results in the build-up of a layer of electrically conductive copper in the holes approximately 1–2 mils in thickness.

In U.S. Pat No. 3,769,179 owned by the assignee of the present invention, an acid copper sulfate electroplating bath is described which has the ability to deposit copper into and through holes in printed circuit boards, even when he holes are as small as ¼th the thickness of the board. This "thru-hole" deposit is obtained from an electroplating bath containing between 70 and 150 g/l of $CuSO_4.5H_2O$ and between 175–300 g/l of $H_2SO_4$. This bath is typically referred to as a high acid, low copper or HA-LC bath. The bath contains a small amount of a grain refining agent. One of the agents mentioned in the patent is instant coffee. Its use in a concentration of 0.1–1.0 g/l contributes to the production of a ductile deposit of copper in the perforations of the board as well as on the flat surfaces thereof. The electroplating bath is operated at temperatures between 20° and 30° C., preferably 22° to 27° C. and a cathode current density in the range of approximately 15–60 and preferably 20–35 amps per square foot.

The bath preferably contains between 1 and 10 cc per liter of 85% by volume phosphoric acid which serves to reduce burning of the deposit at high current densities while at the same time promoting uniform anode corrosion thereby contributing to the formation of a smooth electrodeposit. In addition, the bath contains between 10 and 250 parts per million of chloride ion which serves to prevent step plating, skip plating & tailing.

The patent states that instant coffee includes ground roasted and freeze dried coffee as well as the decaffeinated instant coffees. These coffees are marketed under a number of labels such as Maxim, Nescafe, Sunrise and Tasters Choice.

Because of its ready availability, relatively low cost, and ease of preparation, instant coffee has found widespread commercial acceptance as a grain refining agent in a high acid-low copper plating bath for printed circuit applications. However, the use of the instant coffee as a grain refining agent has not been entirely satisfactory in that its use in the plating bath has resulted in the formation of a gelatinous substance that tends to be codeposited with the copper on the substrate, resulting in a decrease in ductiliy and an increase in the tensile strength of the copper layer. The gelatinous substance appears to be related to the dispersant that is used in the manufacture of the instant coffee. The gel is difficult to remove from the plating bath by filtering because of its tendency to clog the filter medium.

BRIEF DESCRIPTION OF THE INVENTION

It has now been discovered that improved performance and plating results are possible by using regular coffee in place of instant coffee as a grain refining agent in a high acid, low copper electroplating bath.

One of the objects of the present invention is an improved, low maintenance copper electroplating bath useful for electrodepositing a thin layer of copper onto perforated printed circuit boards.

Another object is to enable the use of a plating bath that does not require or demand the use of an efficient and costly filtration system in connection therewith.

Still another object of the present invention is to produce on printed circuit boards an electrodeposited layer of copper having better ductility, (i.e. elongation) tensile strength and thermal stress performance than those obtained from a bath of the type described and claimed in the aforementioned U.S. Pat. No. 3,769,179 wherein the bath is modified by substituting the extract of regular coffee for that of instant coffee.

These and other objects and advantages will become apparent from the following description.

DETAILED DESCRIPTION OF THE PRESENT INVENTION

In more detail, the present invention relates to an improved high acid - low copper electroplating bath and to a method of electroplating printed circuit boards and other non-metallic substrates with a layer of ductile copper. The bath is prepared by mixing together between 70 and 150 g/l of $CuSO_4.5H_2O$ and 175–300 g/l of $H_2SO_4$ to which is added between 0.1 and 1.0 g/l of regularly brewed coffee. Optionally, the bath contains between 1 and 10 cc per liter of phosphoric acid and between 10 and 250 parts per million of chloride ions.

Electroplating is carried out by immersing a conductive substrate such as a printed circuit board which has been previously covered with a layer of electroless copper, into the bath at a temperature maintained at 20° to 40° C. and passing a current through the bath at a current density of between 15 and 60 amperes per square foot.

For purposes of the present invention, the term "regular coffee" relates to coffee that is prepared by aqueous extraction from coffee beans, typically using hot water. The coffee comprises a blend of coffee beans grown in different coffee growing regions. The coffee beans are finely ground for use in a variety of coffee makers but it is understood that the method of extracting the coffee from he coffee bean does not comprise part of the present invention. Typically, extraction is carried out using water at a temperature of between 80° and 95° C. for a time of one to one and one-half hours with agitation. The extracted coffee is then separated from the coffee beans by filtration, decantation or other suitable means. The coffee beans are preferably ground as fine as possible, recognizing that the degree of extraction is dependent upon, among other variables, the particle size of the grind.

Following extraction and separation, the pH of the coffee extract is between about 4 and 5. To avoid mold formation, the pH is adjusted to a value of about 9.5 using sodium hudroxide or sodium carbonate. Furthermore, approximately 1 cc per liter of formaldehyde is preferably added to stabilize the coffee extract.

The concentration of coffee in the extract is dependent upon the method used to extract the coffee from the bean, as well as the temperature, extraction time and degree of agitation. Normally the concentration of the extract will be between 15 and 20 g/l. Of course, further concentration or dilution is possible. The extract is added to the plating bath in an amount sufficient to give a coffee concentration of between 0.1 and 1.0 g/l, preferably about 0.5 g/l or below. Although greater amounts can be used in the plating bath, no discernible benefit is noted when the concentration exceeds 1 g/l. Thus plating economics dictate the use of less than this amount.

Many of the commercial brands of regular coffee may be used to prepare the grain refining agent of the present invention. Typical examples are Maxwell House, Hills Brothers, Fifth Avenue, Folgers and decaffeinated brands such as Sanka. The coffee extract after it is prepared is added directly to the aqueous bath along with the electrolyte and other additives at the time the bath is initially prepared. Because the coffee extract is an electrochemically consumed additive, periodic analysis of the bath or visual examination of the parts being plated will reveal whether the deposit is becoming coarse grained, thereby suggesting the need to add more of the coffee extract to provide additional grain refinement. A simple test is to place a quantity of the plating bath in a Hull Cell, plate a test panel, and inspect the deposit in the high current density area where the loss of grain refinement can readily be determined.

Among the unexpected results to be achieved by using the extract of regular coffee instead of instant coffee as a grain refiner are the following:

(a) The deposit is more ductile unless the plating bath containing the instant coffee is completely filtered through a 5 micron or smaller filter medium at the rate of at least 1½ times per hour while plating to remove undissolved impurities that are introduced into the bath along with the instant coffee. As previously mentioned, it is extremely difficult to completely remove these insoluble impurities because of their gelatinous nature.

(b) The resistance of the copper electrodeposit to thermal stress cracking is better. This can be demonstrated by floating a small plated section of the printed circuit board on molten solder at about 288° C. for 10 seconds. The panel is then cooled, a section mounted, polished and examined using a metallograph. From an insufficiently filtered plating bath containing instant coffee, severe cracking at the corners of the holes will be noted whereas the boards plated in the bath containing the extract of regular coffee will exhibit no such cracking.

(c) The tensile strength and elongation characteristics of the copper deposit is improved. This can be demonstrated by pulling copper foil on a commercial pull tester. The elongation of the copper can be increased by a factor of 50% or more while a favorable reduction of 20% or more in tensile strength results from the substitution of regular coffee for instant coffee in a copper plating bath having insufficient filtration.

(d) Thin copper foils examined to determine structural orientation are found to have a strong isotropic orientation in the (220) plane if deposited from a plating bath containing the extract of regular coffee while those plated from an unfiltered bath containing instant coffee have a random, largely anisotropic orientation in the (111), (200), (220) and (311) planes. The anisotropic structure contributes to poor physical characteristics-tensile strength and elongation- and also adversely affects the thermal stress performance of the deposit.

The following examples are presented to more clearly illustrate the advantages of the present invention:

EXAMPLE I

Fifty gallons of each of the following solutions were prepared:

| | A | B | C |
|---|---|---|---|
| $CuSO_4 . 5H_2O$ | 120 g/l | 120 g/l | 120 g/l |
| $H_2SO_4$ | 210 g/l | 210 g/l | 210 g/l |
| Chloride | 40 mg/l | 40 mg/l | 40 mg/l |
| $H_3PO_4$ (85% by volume) | 8 g/l | 8 g/l | 8 g/l |
| Instant Coffee | 0.5 g/l | — | 0.5 g/l |
| Extract of Reg. Ground Coffee | — | 0.5 g/l | — |

These baths were used to plate 0.062" thick electroless copper coated circuit boards containing 0.030" diameter holes under the following conditions:

| | A | B | C |
|---|---|---|---|
| Agitation | Air | Air | Air |
| Solution Filtration | None | None | Two tank turnovers/hr. through 5 micron media |
| Temperature | 80° F. | 80° F. | 80° F. |
| Current Density | 35 ASF | 35 ASF | 35 ASF |
| Time | 45 min. | 45 min. | 45 min. |

After plating, ½"×1" sections of the plated boards containing holes were punched out and thermal stress tested by floating each on 288° C. molten solder for ten seconds. After cooling, each test coupon was mounted, polished and examined using a metallograph. Those samples plated in Solution A exhibited severe corner cracking whereas those plated in solution B and C exhibited no cracking.

EXAMPLE II

The same solutions, as those in Example I, were used to plate 0.002" thick copper foils onto 4"×6" stainless steel mandrels for determination of physical properties. After plating, the foils were removed from the substrate and ½" wide ×6" long test specimens cut out and placed between the jaws of an Instron Pull Tester. Using a crosshead speed of 0.2 inches per minute and a gauge length of 2 inches, the samples were pulled until fracturing occurred. From the stress/strain curves, elongation and tensile strength values were calculated.

| | A | B | C |
|---|---|---|---|
| Elongation | 12–15% | 20–25% | 20–23% |
| Tensile Strength | 48–51,000 psi | 38–41,000 psi | 39–42,000 psi |

EXAMPLE III

The same solutions as those used in Example I were used to plate copper foils for structure determination. Using a Norelco wide-range goniometer as a diffractometer with a nickel filtered copper target x-ray tube, various orientation peaks were scanned. The foil plated from Solution A exhibited an orientation randomly distributed among the (111), (200), (220) and (311)

planes. The foils plated from Solution B and C exhibited a very strong orientation in the preferred (220) plane.

The bath composition for Example IB, along with the bath temperature, current density and plating time represent a preferred embodiment of the present invention. It is apparent, however, that the range of ingredients in the bath, temperatures, current densities and time can be varied within the limits previously described without departing from the invention, the scope of which is defined by the claims in which;

I claim:

1. The method of electroplating printed circuit boards and other non-metallic substrates with a layer of copper possessing desirable elongation and tensile strength properties comprising (a) Preparing a bath containing between 70 and 150 g/l of $CuSO_4.5H_2O$ and 175-300 g/l free $H_2SO_4$ to which is added between 0.1 and 1.0 g/l of the extract of regular coffee, and (b) Electrodepositing a layer of copper on said substrate from the bath at a current density of between 15 and 60 amps per square foot and at a bath temperature of between 20° and 40° C.

2. The method according to claim 1 wherein the plating bath also contains between 1 and 10 cc per liter of $H_3PO_4$ and between 10 and 250 parts per million of chloride ion.

3. The method of claim 1 in which the coffee is added as an aqueous concentration of 15-20 g of extract per liter.

4. The method of improving the grain refinement of an electroplating bath composed of 70-150 g/l of $CuSO_4.5H_2O$ and 175-300 g/l $H_2SO_4$ comprising adding thereto between 0.1 and 1.0 g/l of the extract of regular coffee.

* * * * *